US008905494B2

(12) United States Patent
Kilic

(10) Patent No.: US 8,905,494 B2
(45) Date of Patent: Dec. 9, 2014

(54) DISHWASHER COMPRISING AN AUTOMATIC DOOR OPENING MECHANISM

(75) Inventor: Osman Kilic, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 0 days.

(21) Appl. No.: 13/698,043

(22) PCT Filed: May 12, 2011

(86) PCT No.: PCT/EP2011/057687

§ 371 (c)(1),
(2), (4) Date: Nov. 14, 2012

(87) PCT Pub. No.: WO2011/141542

PCT Pub. Date: Nov. 17, 2011

(65) Prior Publication Data

US 2013/0057134 A1 Mar. 7, 2013

(30) Foreign Application Priority Data

May 14, 2010 (TR) ..... a 2010 03858

(51) Int. Cl.

| | |
|---|---|
| ***A47B 77/06*** | (2006.01) |
| ***A47L 15/48*** | (2006.01) |
| ***A47L 15/42*** | (2006.01) |
| ***A47L 15/00*** | (2006.01) |
| *E05F 15/12* | (2006.01) |

(52) U.S. Cl.

CPC ..... *A47L 15/4259* (2013.01); *A47L 2501/22* (2013.01); *E05Y 2201/422* (2013.01); *E05F 15/127* (2013.01); *A47L 15/488* (2013.01); *E05Y 2201/434* (2013.01); *A47L 2401/20* (2013.01); *E05Y 2900/304* (2013.01); *E05Y 2201/426* (2013.01); *E05Y 15/20* (2013.01); *E05Y 2201/626* (2013.01); *E05Y 2201/474* (2013.01); *A47L 15/0034* (2013.01)

USPC ..... 312/228; 312/222; 312/328

(58) Field of Classification Search

USPC ..... 312/328, 222, 228, 319.1, 319.2, 312/319.5–319.8, 326, 327, 329; 292/144, 292/201, DIG. 4, DIG. 69, DIG. 71; 134/57 DL, 58 DL

See application file for complete search history.

(56) References Cited

U.S. PATENT DOCUMENTS 3,985,023 A * 10/1976 Guth ..... 70/267
4,951,693 A * 8/1990 Archambault ..... 134/57 DL (Continued)

FOREIGN PATENT DOCUMENTS

DE 2405143 A1 8/1975
EP 0687439 A1 12/1995

(Continued)

*Primary Examiner* — Daniel Rohrhoff
(74) *Attorney, Agent, or Firm* — Venjuris PC

(57) ABSTRACT

A dishwasher (1) is shown comprising a body (2), a door (3) which provides access into the body (2) and opens from the top downwards by rotating around the horizontal axis, a door latch (4) which provides the door (3) to be locked, and a door opening mechanism (6) having a linear actuator (5) that provides the door (3) to be opened automatically at the end of the washing and drying processes such that some gap remains between the door (3) and the body (2).

18 Claims, 3 Drawing Sheets

(56) References Cited

U.S. PATENT DOCUMENTS

Figure 1:
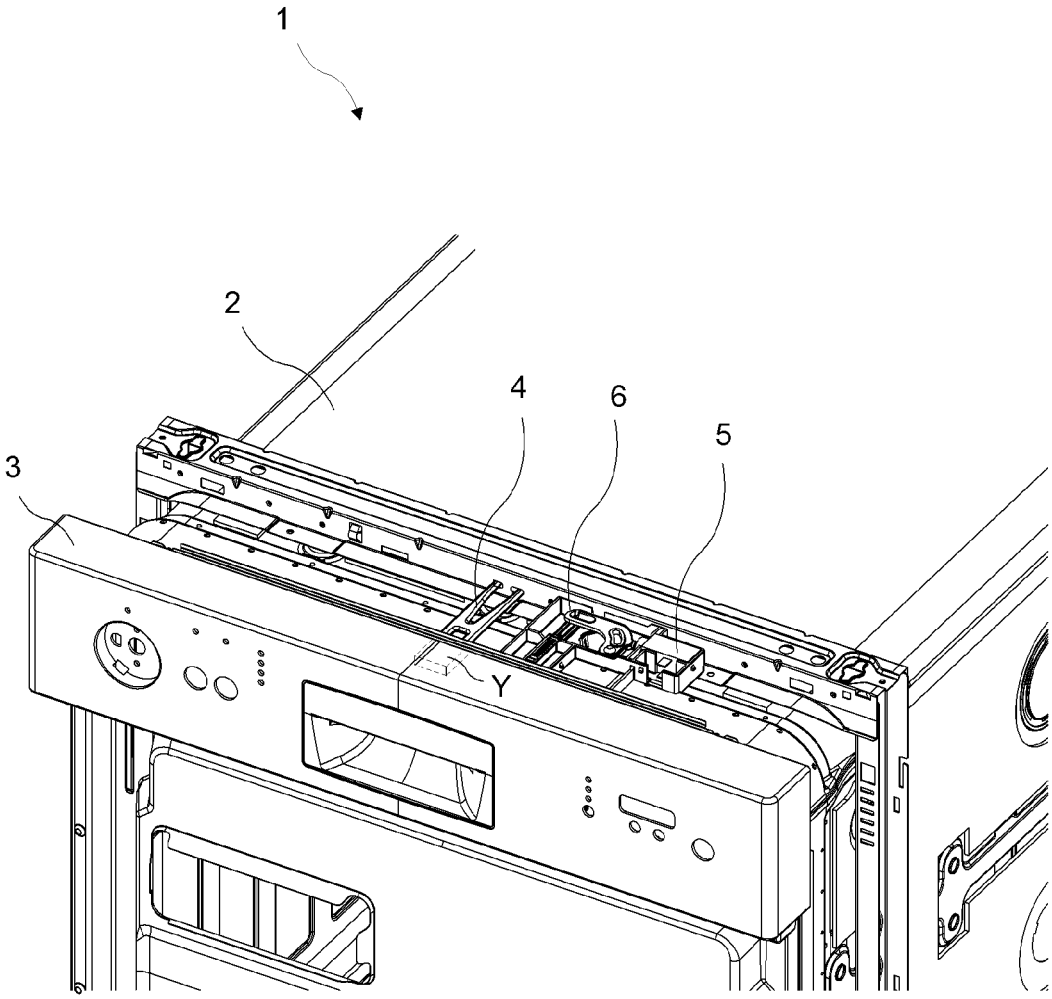

| | | | | |
|---|---|---|---|---|
| 5,881,746 | A | 3/1999 | Buser et al. | |
| 7,731,806 | B2 * | 6/2010 | Hapke | 134/57 DL |
| 7,896,972 | B2 * | 3/2011 | Berends et al. | 134/18 |
| 8,313,583 | B2 * | 11/2012 | May et al. | 134/56 D |
| 8,454,102 | B2 * | 6/2013 | Kim | 312/405 |
| 2011/0016907 | A1 * | 1/2011 | Kang et al. | 62/449 |
| 2011/0036383 | A1 * | 2/2011 | Tiekoetter et al. | 134/57 DL |
| 2011/0279004 | A1 * | 11/2011 | Assmann et al. | 312/228 |

FOREIGN PATENT DOCUMENTS

| | | | |
|---|---|---|---|
| EP | 0711528 | A1 | 5/1996 |
| EP | 1733675 | A2 | 12/2006 |
| EP | 2210547 | A1 | 7/2010 |

* cited by examiner

DISHWASHER COMPRISING AN AUTOMATIC DOOR OPENING MECHANISM

FIELD

The present invention relates to a dishwasher comprising an automatic door opening mechanism.

BACKGROUND

In dishwashers, after the washing process, the drying process is performed. In some embodiments, at the end of the washing and drying processes, the door of the dishwasher can be partially opened automatically, the hot vapor inside is discharged to the outside and the washed items are provided to dry faster. In dishwashers wherein the door is partially opened automatically at the end of the washing and drying processes, applying less heat in the drying process is sufficient and thus, energy is saved. Opening of the dishwasher door automatically, furthermore, prevents the vapor getting cold from condensing and leaving stains on the washed items. In the state of the art, in order that the door is opened automatically, door opening mechanisms are used which extend from the body towards the door and provide the door to be partially opened by pushing the door by the activation of the devices such as solenoid motor or electric motor. In some embodiments, the door latch providing the door to be locked is at the same time a part of the door opening mechanism, keeps the door locked during the washing program and furthermore, provides the door to be partially opened by pushing it at the end of the washing program. When the door is slightly opened by the door opening mechanism at the end of the washing program, the user sometimes tries to close the door by pushing it in the reverse direction, and this causes the door opening mechanism to be damaged.

In the state of the art European Patent No EP1733675 and European Patent Applications No EP0687439 and EP0711528, dishwashers are explained, the doors of which are opened automatically at the end of the washing program.

SUMMARY

The aim of the present invention is the realization of a dishwasher comprising a door opening mechanism that partially opens the dishwasher door automatically at the end of the washing program.

In the dishwasher realized in order to attain the aim of the present invention, explicated in the first claim and the respective claims thereof, the door is provided to be partially opened by means of the door opening mechanism at the end of the washing and drying processes such that some gap remains between the door and the body. The door opening mechanism comprises a first shaft which moves towards the door by the effect of a linear actuator such as a solenoid or electric motor, a second shaft which is situated at the front side of the first shaft and opens the door by pushing it, and a spring which is located between the first shaft and the second shaft and which can be stretched or compressed in the same direction as the first shaft and the second shaft, in the direction of opening-closing motion of the door. The spring is preferably of helical type, and one end thereof is connected to the first shaft and the other end to the second shaft.

The door opening mechanism comprises an L-shaped crank which transmits the linear motion received from the actuator to the first shaft by rotating the direction of the motion 90 degrees. The door opening mechanism, furthermore, comprises a casing, a pin which provides the crank to be pivotally connected to the casing, a motion transmitter which provides the connection between the crank and the first shaft and which is connected to the first shaft, a channel which is located on the crank, bears the motion transmitter and actuates the first shaft by means of the motion transmitter according to the motion of the crank, and a guide which provides the crank to move inside the casing properly without any disturbance.

In an embodiment of the present invention, the door opening mechanism applies a stroke that provides the first shaft, the spring and the second shaft to open the door in an amount only enough to release the door latch from the housing thereof on the door.

In another embodiment of the present invention, the door opening mechanism applies a stroke that provides the first shaft, the spring and the second shaft to open the door in an amount that allows vapor discharge.

In the dishwasher of the present invention, the door is slightly opened automatically by means of the door opening mechanism at the end of the washing and drying processes and a fast drying is performed by discharging the vapor accumulated inside the body at the end of the washing and drying processes to the outside. In the partially open position of the door, when the user tries to close the door, only the spring between the second shaft pushing the door and the first shaft actuating the second shaft is compressed and the other components in the door opening mechanism are not strained.

BRIEF DESCRIPTIONS OF THE DRAWINGS

The dishwasher realized in order to attain the aim of the present invention is illustrated in the attached figures, where:

FIG. 1—is the detailed view of a dishwasher and a door opening mechanism.

Figure 2:
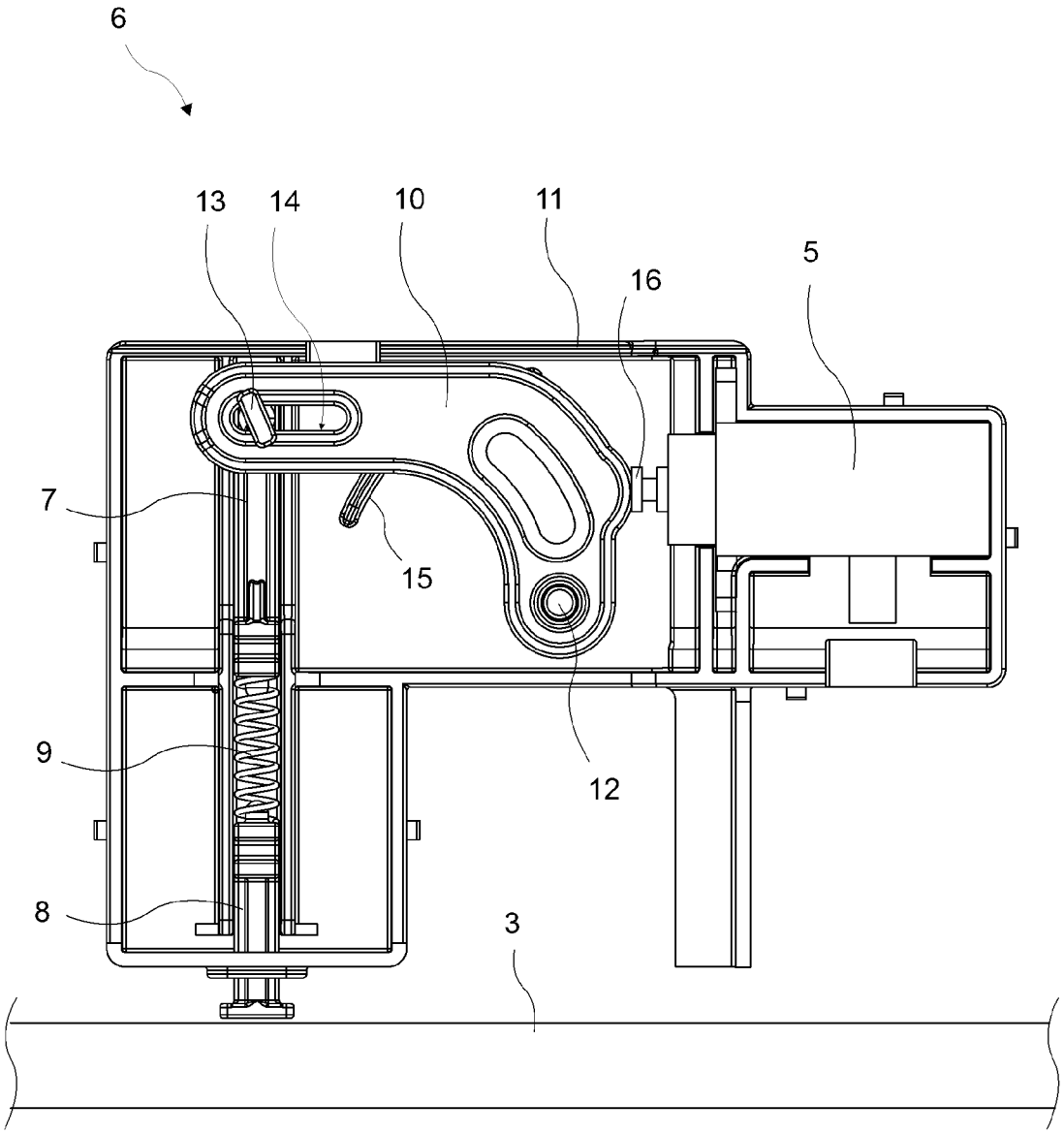

FIG. 2—is the top view of a door opening mechanism in the passive state.

Figure 3:
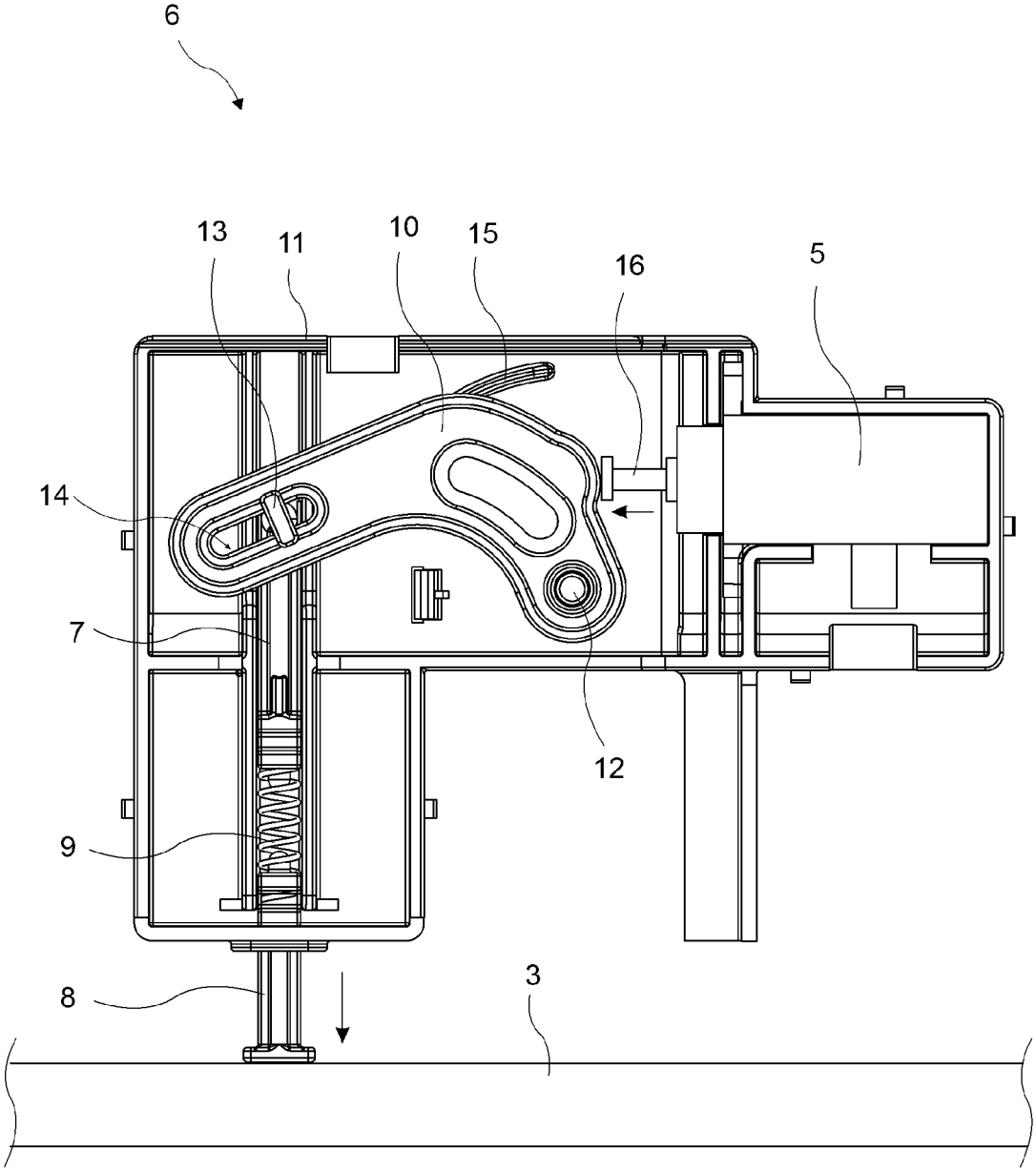

FIG. 3—is the top view of a door opening mechanism in the active state.

DETAILED DESCRIPTION

The elements illustrated in the figures are numbered as follows:

1. Dishwasher
2. Body
3. Door
4. Door latch
5. Actuator
6. Door opening mechanism
7. First shaft
8. Second shaft
9. Spring
10. Crank
11. Casing
12. Pin
13. Motion transmitter
14. Channel
15. Guide
16. Pusher The dishwasher (1) comprises a body (2), a door (3) which provides access into the body (2) and opens from the top downwards by rotating around a horizontal axis, a door latch (4) which provides the door (3) to be locked, and a door opening mechanism (6) which has a linear actuator (5) such as a solenoid or electric motor that provides the door (3) to be partially opened by being pushed at the end of the washing and drying processes such that some gap remains between the door (3) and the body (2).

The door opening mechanism (6) comprises a first shaft (7) which moves towards the door (3) by the effect of the actuator (5), a second shaft (8) which is in the same direction as the first shaft (7) and is situated between the first shaft (7) and the door (3) and opens the door (3) by pushing it, and a spring (9) which is located between the first shaft (7) and the second shaft (8) and which can be stretched or compressed by the first shaft (7) and the second shaft (8) in the same direction as the first shaft (7) and the second shaft (8), in the direction of opening and closing motion of the door (3).

In the preferred embodiment of the present invention, the spring (9) is of helical type, and one end thereof is connected to the first shaft (7) and the other end to the second shaft (8).

In the dishwasher (1), in order to discharge the vapor present inside the body (2) at the end of the washing and drying processes, the linear actuator (5) in the door opening mechanism (6) is activated and actuates the first shaft (7), and the second shaft (8) that is in the same direction with the first shaft (7) pushes the door (3) out of the body (2) by moving forward by the effect of the pushing force of the first shaft (7) and the spring (9) between the first shaft (7) and the second shaft (8). Since a spring (9) is disposed between the first shaft (7) and the second shaft (8), the second shaft (8) that contacts the door (3) compresses the spring (9) by moving backwards when the user tries to close the door (3) while the door (3) is partially open. Since the spring (9) can be stretched or compressed in the opening-closing direction of the door (3) between the first shaft (7) and the second shaft (8), only the spring (9) is affected by the door (3) motion in the closing direction and the other components of the door opening mechanism (6) are not strained.

The door opening mechanism (6) comprises an L-shaped crank (10) which is located between the actuator (5) and the first shaft (7) and transmits the linear motion received from the actuator (5) to the first shaft (7) by rotating the direction of the motion 90 degrees. The door opening mechanism (6) occupies less space by means of the L-shape of the crank (10), and by rotating the actuator (5) motion 90 degrees, transmits the motion to the first shaft (7), hence to the spring (9) and to the second shaft (8) pushing the door (3), in the narrow space at the upper side of the door (3).

The door opening mechanism (6), furthermore, comprises a casing (11) which is mounted to the body (2), a pin (12) which provides the crank (10) to be pivotally connected to the casing (11), a motion transmitter (13) which is connected to the first shaft (7) and provides the connection between the crank (10) and the first shaft (7), and the transmission of the motion of the crank (10) to the first shaft (7), a channel (14) which is located on the crank (10), bears the motion transmitter (13) such that the motion transmitter (13) can make relative motion therein and which actuates the first shaft (7) by means of the motion transmitter (13) according to the motion of the crank (10), and a guide (15) which provides the crank (10) to move inside the casing (11) properly without any disturbance.

The stroke adjustment of the first shaft (7) and hence, of the spring (9) and the second shaft (8) can be made by the producer changing the channel (14) dimensions and the connection positions of the pin (12) and the motion transmitter (13) and the door (3) is provided to open in the desired amount.

In an embodiment of the present invention, the door opening mechanism (6) applies a stroke that provides the first shaft (7), the spring (9) and the second shaft (8) to open the door (3) in an amount only enough to release the door latch (4) from the housing (Y) thereof on the door (3). In this embodiment, the door opening mechanism (6) only provides the door latch (4) to be released from the housing (Y) on the door (3) by applying a low stroke when activated, and the door (3) is opened a little bit more by using any another door opening method apart from the door opening mechanism (6) and the vapor inside the body (2) is discharged to the outside surrounding.

In another embodiment of the present invention, the door opening mechanism (6) applies a stroke that provides the first shaft (7), the spring (9) and the second shaft (8) to open the door (3) in an amount that allows vapor discharge. In this embodiment, the door opening mechanism (6) brings the door latch (4) to a free state and at the same time opens the door (3) in the desired amount by applying a high stroke when activated.

The actuator (5) comprises a pusher (16) which pushes the crank (10) by moving towards the crank (10) when electric current is applied and resumes its initial position when the opening of the door (3) in the desired amount is completed and the applied electric current is cut off.

In the dishwasher (1) of the present invention, the door (3) is opened automatically by means of the door opening mechanism (6) at the end of the washing and drying processes and a fast drying is performed by discharging the vapor accumulated in the body (2) at the end of the washing and drying processes to the outside. In the partially open position of the door (3), when the user tries to close the door (3), only the spring (9) between the second shaft (8) pushing the door (3) and the first shaft (7) is compressed and the other components in the door opening mechanism (6) are not strained and prevented from being damaged.

It is to be understood that the present invention is not limited by the embodiments disclosed above and a person skilled in the art can easily introduce different embodiments. These should be considered within the scope of the protection disclosed by the claims of the present invention.

The invention claimed is:

1. A dishwasher (1) comprising a body (2), a door (3) which provides access into the body (2), a door latch (4) that provides the door (3) to be locked, and a door opening mechanism (6) having a linear actuator (5) which provides the door (3) to be partially opened by being pushed at the end of the washing and drying processes such that some gap remains between the door (3) and the body (2), characterized in that a first shaft (7) which moves towards the door (3) by the effect of the actuator (5), a second shaft (8) which is in the same direction as the first shaft (7) and is situated between the first shaft (7) and the door (3) and opens the door (3) by pushing it, and a spring (9) which is located between the first shaft (7) and the second shaft (8) and which can be stretched or compressed in the same direction as the first shaft (7) and the second shaft (8), in the direction of opening and closing motion of the door (3).

2. A dishwasher (1) as in claim 1, characterized in that the door opening mechanism (6) comprising a spring (9) which is of helical type, and one end of which is connected to the first shaft (7) and the other end to the second shaft (8).

3. A dishwasher (1) as in claim 2, characterized in that the door opening mechanism (6) which applies a stroke that provides the first shaft (7), the spring (9) and the second shaft (8) to open the door (3) in an amount only enough to release the door latch (4) from a housing (Y) thereof on the door (3).

4. A dishwasher (1) as in any one of the claim 2, characterized in that the door opening mechanism (6) which applies a stroke that provides the first shaft (7), the spring (9) and the second shaft (8) to open the door (3) in an amount that allows vapor discharge.

5. A dishwasher (1) as in claim 1, characterized in that the door opening mechanism (6) which applies a stroke that provides the first shaft (7), the spring (9) and the second shaft (8) to open the door (3) in an amount only enough to release the door latch (4) from a housing (Y) thereof on the door (3).

6. A dishwasher (1) as in claim 1, characterized in that the door opening mechanism (6) which applies a stroke that provides the first shaft (7), the spring (9) and the second shaft (8) to open the door (3) in an amount that allows vapor discharge.

7. A dishwasher (1) comprising a body (2), a door (3) which provides access into the body (2), a door latch (4) that provides the door (3) to be locked, and a door opening mechanism (6) having a linear actuator (5) which provides the door (3) to be partially opened by being pushed at the end of the washing and drying processes such that some gap remains between the door (3) and the body (2), characterized in that a first shaft (7) which moves towards the door (3) by the effect of the actuator (5), a second shaft (8) which is in the same direction as the first shaft (7) and is situated between the first shaft (7) and the door (3) and opens the door (3) by pushing it, and a spring (9) which is located between the first shaft (7) and the second shaft (8) and which can be stretched or compressed in the same direction as the first shaft (7) and the second shaft (8), in the direction of opening and closing motion of the door (3) and wherein the door opening mechanism (6) comprising an L-shaped crank (10) which is located between the actuator (5) and the first shaft (7) and transmits the linear motion received from the actuator (5) to the first shaft (7) by rotating the direction of the motion 90 degrees.

8. A dishwasher (1) as in claim 7, characterized in that the door opening mechanism (6) comprising a casing (11), a pin (12) which provides the crank (10) to be pivotally connected to the casing (11), a motion transmitter (13) which is connected to the first shaft (7) and provides the transmission of the motion of the crank (10) to the first shaft (7), a channel (14) which is located on the crank (10) and bears the motion transmitter (13), and a guide (15) which provides the crank (10) to move inside the casing (11).

9. A dishwasher (1) as in claim 8, characterized in that the door opening mechanism (6) which applies a stroke that provides the first shaft (7), the spring (9) and the second shaft (8) to open the door (3) in an amount only enough to release the door latch (4) from a housing (Y) thereof on the door (3).

10. A dishwasher (1) as in any one of the claim 8, characterized in that the door opening mechanism (6) which applies a stroke that provides the first shaft (7), the spring (9) and the second shaft (8) to open the door (3) in an amount that allows vapor discharge.

11. A dishwasher (1) as in claim 7, characterized in that the door opening mechanism (6) which applies a stroke that provides the first shaft (7), the spring (9) and the second shaft (8) to open the door (3) in an amount only enough to release the door latch (4) from a housing (Y) thereof on the door (3).

12. A dishwasher (1) as in any one of the claim 7, characterized in that the door opening mechanism (6) which applies a stroke that provides the first shaft (7), the spring (9) and the second shaft (8) to open the door (3) in an amount that allows vapor discharge.

13. A dishwasher (1) comprising a body (2), a door (3) which provides access into the body (2), a door latch (4) that provides the door (3) to be locked, and a door opening mechanism (6) having a linear actuator (5) which provides the door (3) to be partially opened by being pushed at the end of the washing and drying processes such that some gap remains between the door (3) and the body (2), characterized in that a first shaft (7) which moves towards the door (3) by the effect of the actuator (5), a second shaft (8) which is in the same direction as the first shaft (7) and is situated between the first shaft (7) and the door (3) and opens the door (3) by pushing it, and a spring (9) which is located between the first shaft (7) and the second shaft (8) and which can be stretched or compressed in the same direction as the first shaft (7) and the second shaft (8), in the direction of opening and closing motion of the door (3) and wherein the door opening mechanism (6) comprises a spring (9) which is of helical type, and one end of which is connected to the first shaft (7) and the other end to the second shaft (8) and wherein the door opening mechanism (6) comprises an L-shaped crank (10) which is located between the actuator (5) and the first shaft (7) and transmits the linear motion received from the actuator (5) to the first shaft (7) by rotating the direction of the motion 90 degrees.

14. A dishwasher (1) as in claim 13, characterized in that the door opening mechanism (6) comprising a casing (11), a pin (12) which provides the crank (10) to be pivotally connected to the casing (11), a motion transmitter (13) which is connected to the first shaft (7) and provides the transmission of the motion of the crank (10)*to* the first shaft (7), a channel (14) which is located on the crank (10) and bears the motion transmitter (13), and a guide (15) which provides the crank (10) to move inside the casing (11).

15. A dishwasher (1) as in claim 14, characterized in that the door opening mechanism (6) which applies a stroke that provides the first shaft (7), the spring (9) and the second shaft (8) to open the door (3) in an amount only enough to release the door latch (4) from a housing (Y) thereof on the door (3).

16. A dishwasher (1) as in any one of the claim 14, characterized in that the door opening mechanism (6) which applies a stroke that provides the first shaft (7), the spring (9) and the second shaft (8) to open the door (3) in an amount that allows vapor discharge.

17. A dishwasher (1) as in claim 13, characterized in that the door opening mechanism (6) which applies a stroke that provides the first shaft (7), the spring (9) and the second shaft (8) to open the door (3) in an amount only enough to release the door latch (4) from a housing (Y) thereof on the door (3).

18. A dishwasher (1) as in any one of the claim 13, characterized in that the door opening mechanism (6) which applies a stroke that provides the first shaft (7), the spring (9) and the second shaft (8) to open the door (3) in an amount that allows vapor discharge.

* * * * *